US011008639B2

(12) United States Patent
Yang et al.

(10) Patent No.: US 11,008,639 B2
(45) Date of Patent: May 18, 2021

(54) POWDER METALLURGY TITANIUM ALLOYS

(71) Applicant: BAOSHAN IRON & STEEL CO., LTD., Shanghai (CN)

(72) Inventors: Yafeng Yang, Victoria (AU); Ma Qian, Victoris (AU); Shudong Luo, Queensland (AU); Jifeng Sun, Shanghai (CN); Aijun Huang, Shanghai (CN)

(73) Assignee: Baoshan Iron & Steel Co., Ltd., Shanghai (CN)

( * ) Notice: Subject to any disclaimer, the term of this patent is extended or adjusted under 35 U.S.C. 154(b) by 302 days.

(21) Appl. No.: 15/759,713

(22) PCT Filed: Sep. 16, 2015

(86) PCT No.: PCT/CN2015/089698
§ 371 (c)(1),
(2) Date: Mar. 13, 2018

(87) PCT Pub. No.: WO2017/045146
PCT Pub. Date: Mar. 23, 2017

(65) Prior Publication Data

US 2019/0048439 A1 Feb. 14, 2019

(51) Int. Cl.
*C22C 14/00* (2006.01)
*C22C 1/04* (2006.01)
(Continued)

(52) U.S. Cl.
CPC ..... *C22C 14/00* (2013.01); *B22F 3/16* (2013.01); *C22C 1/0458* (2013.01);
(Continued)

(58) Field of Classification Search
CPC ..... C22C 1/0458; C22C 14/00; C22C 29/14; C22C 32/0073; B22F 1/0003;
(Continued)

(56) References Cited

U.S. PATENT DOCUMENTS 2,661,286 A 12/1953 Swazy
4,219,357 A 8/1980 Yolton et al.
(Continued)

FOREIGN PATENT DOCUMENTS

CN 101962721 2/2011
CN 101962721 A * 2/2011
(Continued)

OTHER PUBLICATIONS

Y. F. Yang, S. D. Luo, G. B. Schaffer, M. Qian, "The sintering, sintered microstructure and mechanical properties of Ti—Fe—Si alloys", Metallurgical and Materials Transactions A 2012, 43A, 4896-4906.

(Continued)

*Primary Examiner* — Vanessa T. Luk
(74) *Attorney, Agent, or Firm* — Thomas Horstemeyer, LLP

(57) ABSTRACT

A sintered Ti alloy comprising: 4 to 6 wt. % iron; 1 to 4 wt. % aluminium or 1 to 3 wt. % copper; >0 to 0.5 wt. % silicon; >0 to 0.3 wt. % boron; >0 to 1 wt. % lanthanum, and the balance being titanium with incidental impurities. In the associated powder metallurgy formation process, the boron and lanthanum content is preferably introduced into a blended powder mixture in the form of lanthanum boride ($LaB_6$).

20 Claims, 6 Drawing Sheets

(51) Int. Cl.
*B22F 3/16* (2006.01)
*C22C 1/10* (2006.01)

(52) U.S. Cl.
CPC ..... *C22C 1/1084* (2013.01); *B22F 2998/10* (2013.01); *B22F 2999/00* (2013.01)

(58) Field of Classification Search
CPC ..... B22F 3/1039; B22F 2301/205; B22F 2003/1014; B22F 2003/1032; B22F 2003/1042; B22F 2003/1046; B22F 2003/1051; B22F 2003/1052; B22F 2003/1053; B22F 2003/1054; B22F 2003/145; B22F 2003/153; B22F 2003/166; B22F 3/10; B22F 3/1003; B22F 3/1007; B22F 3/101; B22F 3/1017; B22F 3/1021; B22F 3/1025; B22F 3/1028; B22F 3/1035; B22F 3/105; B22F 3/12; B22F 3/1208; B22F 3/1216; B22F 3/1225; B22F 3/1233; B22F 3/1241; B22F 3/125; B22F 3/1258; B22F 3/1266; B22F 3/1275; B22F 3/1283; B22F 3/1291; B22F 3/14; B22F 3/15; B22F 3/156; B22F 3/16; B22F 3/162; B22F 3/164; B22F 3/168
See application file for complete search history.

(56) References Cited

U.S. PATENT DOCUMENTS

| | | | | |
|---|---|---|---|---|
| 4,810,465 | A * | 3/1989 | Kimura | C22C 14/00 420/417 |
| 5,156,807 | A * | 10/1992 | Nagata | C22C 14/00 148/421 |
| 5,409,518 | A | 4/1995 | Saito et al. | |
| 6,638,336 | B1 | 10/2003 | Drozdenko et al. | |
| 7,442,266 | B2 | 10/2008 | Furuta et al. | |
| 7,993,577 | B2 | 8/2011 | Duz et al. | |
| 8,834,601 | B2 | 9/2014 | Haidar | |
| 2003/0211001 | A1 | 11/2003 | Ivaishin et al. | |
| 2015/0118099 | A1 | 4/2015 | Frommeyer et al. | |
| 2015/0147225 | A1 | 5/2015 | Lee et al. | |

FOREIGN PATENT DOCUMENTS

| | | | |
|---|---|---|---|
| CN | 101962721 | Y | 2/2011 |
| CN | 104404300 | | 3/2015 |
| CN | 104404300 | A | 3/2015 |
| JP | 2002206124 | | 7/2002 |
| JP | 2002206124 | A | 7/2002 |
| KR | 20130142800 | | 12/2013 |
| KR | 20130142800 | A * | 12/2013 |
| WO | 1997001409 | | 1/1997 |
| WO | 2002050324 | | 6/2002 |
| WO | 2013022531 | | 2/2013 |
| WO | 2013105699 | | 7/2013 |

OTHER PUBLICATIONS

Liu, Y., Liu, Y., Wang, B., Qiu, J., Liu, B., & Tang, H. (2010). Microstructures evolution and mechanical properties of a powder metallurgical titanium alloy with yttrium addition. Materials and Manufacturing Processes, 25(8), 735-739.

Liu, Yong, L. F. Chen, H. P. Tang, Chain T. Liu, B. Liu, and B. Y. Huang. "Design of powder metallurgy titanium alloys and composites." Materials Science and Engineering: A 418, No. 1 (2006): 25-35.

Y. Chen, K.-S. Hwang,Description: http://www.scopus.com/static/images/s.gif K.-L. Ng, "Effect of cooling process on the α phase formation and mechanical properties of sintered Ti—Fe alloys", Materials Science and Engineering A, 2011, vol. 528, pp. 4556-4563.

P.G. Esteban, E.M. Ruiz-Navas and E. Gordo, "Influence of Fe content and particle size the on the processing and mechanical properties of low-cost Ti—xFe alloys", Materials Science and Engineering A, 2010, vol. 527, pp. 5664-5669.

S. D. Luo, Y. F. Yang, G. B. Schaffer, M. Qian, "The effect of a small addition of boron on the sintering densification, microstructure and mechanical properties of powder metallurgy Ti—7Ni alloy", Journal of Alloys and Compounds, 2013, vol. 555, 339-346.

Y. F. Yang, M. Yan, S. D. Luo. G. B. Schaffer, M. Qian, "Modification of the α-Ti laths to near equiaxed α-Ti grains in as-sintered titanium and titanium alloys by a small addition of boron", Journal of Alloys and Compounds 2013, 579, 553-557.

Liu, Y., Liu, Y. B., Wang, B., & Tang, H. P. (2012). Rare Earth Element: Is it a Necessity for PM Ti Alloys?, Key Engineering Materials, 520, 41-48.

T. Saito, The Automotive Application of Discontinuously Reinforced TiB—Ti Composites, JOM, 2004, No. 5, 33-36.

O.M. Ferri T. Ebel, R. Bormann, The influence of a small boron addition on the microstructure and mechanical properties of Ti—6Al—4V fabricated by metal injection moulding, Adv. Eng. Mater. 2011, 13, 436-447.

O.M. Ivasishin, D.G. Savvakin, The impact of diffusion on synthesis of high-strength titanium alloys from elemental powder blends, Key Engineering Materials, 2010, 436, 113-121.

W. Wei, Y. Liu, K. Zhou, B. Huang, Effect of Fe addition on sintering behaviour of titanium powder, Powder Metallurgy, 2003, 46, 246-250.

M.M. Stupel, F. Homstein, B.Z. Weiss, M. Ron, Study of the sintering of a Ti-9pctFe system by Mössbauer spectroscopy, Metallurgical Transactions A, 1976, 7A, 689-693.

M. Qian, "Cold compaction and sintering of titanium and its alloys for near-net-shape or preform fabrication", International Journal of Powder Metallurgy, 2010, vol. 46, No. 5, 29-44.

Zhu, J., A. Kamiya, et al. (2003). "Influence of boron addition on microstructure and mechanical properties of dental cast titanium alloys." Materials Science and Engineering a—Structural Materials Properties Microstructure and Processing 339(1-2): 53-62.

Yang, Y. F., S. D. Luo, et al. (2014). "The effect of lanthanum boride on the sintering, sintered microstructure and mechanical properties of titanium and titanium alloys." Materials Science and Engineering a—Structural Materials Poperties Microstructure and Processing 618: 447-455.

Huang, L. and Chen, Y. (2015). "A study on the microstructures and mechanical properties of forged trace-boron-modified Ti—B20 alloy", Materials and Design 66:110-117.

Luan, J. H., Z. B. Jiao, et al. (2015). Effects of Boron additions and solutionizing treatments on microstructures and ductility of forged Ti—6Al—4V alloys, Journal of Alloys and Compounds 624: 170-178.

PCT/CN2015/089698 International Search Report and Written Opinion dated Jun. 22, 2016.

International Search Report and Written Opinion dated Jun. 22, 2016 for PCT Patent Application No. PCT/CN2015/089698.

1st Office Action dated Oct. 22, 2019 for Chinese Patent Application No. 201580083130.9.

Yang, Y. F., et al. "The sintering, sintered microstructure and mechanical properties of Ti—Fe—Si alloys." Metallurgical and Materials Transactions A 43.12 (2012): 4896-4906.

Yang, Y. F., S. D. Luo, and Ma Qian. "The effect of lanthanum boride on the sintering, sintered microstructure and mechanical properties of titanium and titanium alloys." Materials Science and Engineering: A 618 (2014): 447-455.

"Wear-resistant coating layer of Titanium and Ti Alloy, and properties thereof", p. 26-27, Chinese Northeast University Press, Dec. 31, 2006, edited by Ding L. X. etc.

* cited by examiner

POWDER METALLURGY TITANIUM ALLOYS

CROSS-REFERENCE TO RELATED APPLICATIONS

This application is a 371 U.S. National Phase of PCT International Application No. PCT/CN2015/089698 filed on Sep. 16, 2015, which is incorporated by reference herein in their entirety.

TECHNICAL FIELD

The present invention relates to low-cost powder metallurgy titanium alloys and their manufacture by a simple press-and-sinter approach. The invention is particularly applicable for press-and-sinter formed alloys and it will be convenient to hereinafter disclose the invention in relation to that exemplary application. However, it is to be appreciated that the invention is not limited to that application.

BACKGROUND TO INVENTION

The following discussion of the background to the invention is intended to facilitate an understanding of the invention. However, it should be appreciated that the discussion is not an acknowledgement or admission that any of the materials referred to was published, known or part of the common general knowledge as at the priority date of the application.

Titanium alloys are advanced structural materials possessing an array of desirable properties that are not readily achievable with any other material. These include excellent corrosion resistance to seawater environments, high specific strength and fracture toughness, good compatibility with composites, long durability with little or no maintenance, excellent biocompatibility, and the like. However, such alloys can have a very low yield because of production difficulties involved in conventional ingot metallurgy based methods. Powder metallurgy can overcome a number of these disadvantages by permitting the production of parts that need only a few finishing steps.

Of many powder metallurgy methods, the conventional press-and-sinter or cold-compaction-and-sinter powder metallurgy approach is technically the simplest and economically the most attractive near-net shape manufacturing process. This approach typically uses a mixed powder method involving the mixing of titanium powder with various alloying powders, followed by compacting and sintering. This method offers several advantages, including the flexibility of using inexpensive raw material powder, high yields, and simple production process, which can lead to a considerable cost saving compared to conventional ingot metallurgy based manufacturing methods.

Further cost reduction of powder metallurgy Ti components also depends on the availability of lower-cost powder metallurgy Ti alloys that can offer desired properties. From an alloy design perspective, a wide variety of alloying elements can be introduced to titanium for various alloying purposes. However, from a cost perspective it is preferable to use lower cost or inexpensive alloying elements, such as iron, aluminium, silicon, copper, and the like. It is probable that small amounts of higher cost alloying elements such as rare earth elements may be needed in order to enable the achievement of desired microstructures and/or mechanical properties.

Hydrogenated-dehydrogenated (HDH) titanium powder or hydrogenated titanium powder made directly from the titanium sponge offers an attractive basis for current powder metallurgy Ti alloy development due to its affordable price and manageable oxygen content. It is likely that both powders will continue to be major sources of cost-affordable Ti powder for the future powder metallurgy Ti market.

The oxygen content of HDH Ti powder products varies over a wide range. Inexpensive HDH Ti powder products normally contain ≥0.25 wt. % oxygen. Ti powder has high chemical affinity for oxygen (O) and each Ti powder particle is constantly enveloped with a surface oxide film. However, unlike other metal powders, owing to the high solubility of O in Ti (up to 14 wt. %), the surface titanium oxide film on each titanium powder particle will dissolve into the underlying Ti metal from temperatures above approximately 500° C. leading to an increased O content in solid solution. In addition, there is an unavoidable pick-up of oxygen during the powder handling process and especially the subsequent sintering process. Consequently, the oxygen content in solid solution of the as-sintered titanium components may readily exceed 0.33 wt. %, which is the critical oxygen content identified for powder metallurgy (PM) Ti-6Al-4V (wt. %) [see reference 1]. This critical oxygen content may vary for different PM Ti alloys [see reference 2]. However, it has been well established that the ductility of both unalloyed Ti and Ti alloys is sensitive to their O content. Being able to control the O content thus lies at the heart of the fabrication of cost affordable ductile Ti alloys from inexpensive powder for structural applications.

It is technically challenging to directly use such inexpensive HDH titanium powder for the production of structural titanium components. The two prime reasons are that:

(i) current commercial grade titanium alloys are not designed for powder metallurgy processing; it is therefore difficult to form these alloys to a near pore-free density (e.g. >99% theoretical density) by the simple press-and-sinter approach; and (ii) the as-sintered titanium alloys are often not ductile enough (e.g. tensile elongation <4%) or are even lack of ductility due to resulting high oxygen content discussed previously and the existence of large pores.

It has proved to be demanding to address these two challenges. Although alloy design is only one aspect of the problem, having a low-cost, readily sinterable titanium alloy will serve as an important starting point to realize low-cost titanium powder metallurgy.

It would therefore be desirable to provide a new and/or alternative titanium alloy which can provide a low-cost alternative to existing press-and-sintered titanium alloys.

SUMMARY OF THE INVENTION

In a first aspect, this invention provides a new low-cost titanium alloy containing Fe, Al or Cu, Si, B and La. This first aspect provides a sintered Ti alloy comprising:

4 to 6 wt. % iron;

1 to 4 wt. % aluminium or 1 to 3 wt. % copper;

>0 to 0.5 wt. % silicon;

>0 to 0.3 wt. % boron;

>0 to 1 wt. % lanthanum, and the balance being titanium with incidental impurities.

The present invention therefore provides a new powder metallurgy titanium-iron based alloy which is formulated to utilise hydrogenated-dehydrogenated (HDH) Ti powder or hydrogenated titanium ($TiH_2$) powder to form the alloy. Further, these sintered titanium alloys of the present invention are designed to be produced primarily using near-net or net shape fabrication through a press-and-sinter approach. Both aspects assist in making titanium components manufactured from this alloy with attractive cost affordability.

The alloy of the present invention generally contains 4 to 6 wt. % Fe, 1 to 4 wt. % Al or 1 to 3 wt. % Cu, >0 to 0.5 wt. % Si, >0 to 0.3 wt. % B, and >0 to 1 wt. % La. In some embodiments, the iron content of the sintered titanium alloy of the present invention is from 5 to 6 wt. %, preferably about 5.5 wt. %. In some embodiments, the aluminium content of the sintered titanium alloy of the present invention is from 2 to 4 wt. %, preferably about 2.5 wt. %. In some embodiments, the copper content of the sintered titanium alloy of the present invention is from 1 to 3 wt. %, preferably from 2 and 3 wt. %, more preferably about 2.5 wt. %. In some embodiments, the silicon content of the sintered titanium alloy of the present invention is from 0.05 to 0.5 wt. %, preferably from 0.1 to 0.5 wt. %, more preferably about 0.1 wt. %. In some embodiments, the boron content of the sintered titanium alloy of the present invention is from 0.05 to 0.3 wt. %, preferably from 0.09 to 0.21 wt. %, more preferably about 0.15 wt. %. In some embodiments, the La content of the sintered titanium alloy of the present invention is from 0.1 to 1 wt. %, preferably from 0.2 to 0.49 wt. %, more preferably about 0.35 wt. %.

The above can provide a variety of different alloying compositions. In preferred embodiments, the sintered Ti alloy comprises 4 to 6 wt. % iron; 1 to 4 wt. % aluminium or 1 to 3 wt. % copper; 0.05 to 0.5 wt. % silicon; 0.05 to 0.3 wt. % boron; 0.1 to 1 wt. % lanthanum, and the balance titanium with incidental impurities. In some embodiments, the sintered Ti alloy comprises 4 to 6 wt. % iron; 2 to 4 wt. % aluminium or 2 to 3 wt. % copper; 0.1 to 0.25 wt. % silicon; 0.1 to 0.21 wt. % boron; 0.3 to 0.49 wt. % lanthanum, and the balance titanium with incidental impurities. In some embodiments, the sintered Ti alloy comprises 4 to 6 wt. % iron; 2 to 4 wt. % aluminium or 2 to 3 wt. % copper; 0.1 to 0.25 wt. % silicon; 0.09 to 0.21 wt. % boron; 0.2 to 0.49 wt. % lanthanum, and the balance titanium with incidental impurities.

The as-sintered mechanical properties of these low-cost new titanium alloys are suited to a wide range of applications. The as-sintered alloys show excellent tensile properties, matching the ASTM B381-10 standard specifications for Ti-6Al-4V forgings. These mechanical properties include at least one of the following:

the sintered Ti alloy having an ultimate tensile strength of at least 900 MPa, preferably at least 950 MPa. In some embodiments, the sintered Ti alloy has an ultimate tensile strength from 950 MPa to 1100 MPa or greater;

the sintered Ti alloy having a yield strength of at least 800 MPa, preferably 830 MPa. In some embodiments, the sintered Ti alloy has a yield strength from 830 MPa to 950 MPa or greater;

the sintered Ti alloy having an elongation percentage of at least 6%, preferably at least 7%. In some embodiments, the sintered Ti alloy has an elongation percentage from 7% to 10% or greater.

In an exemplary embodiment, the sintered Ti alloy has an ultimate tensile strength of at least 900 MPa, yield strength of at least 800 MPa and elongation percentage of at least 6%. In another embodiment, the sintered Ti alloy has an ultimate tensile strength of at least 950 MPa, yield strength of at least 830 MPa and elongation percentage of at least 7%.

The as-sintered mechanical properties can vary depending on the composition of the Ti alloy. In some embodiments, the sintered Ti alloy may comprise 4 to 6 wt. % iron, 1 to 4 wt. % aluminium, 0.1 to 0.25 wt. % silicon, 0.09 to 0.2 wt. % boron, 0.2 to 0.49 wt. % lanthanum and the balance titanium with incidental impurities and have an ultimate tensile strength of at least 950 MPa, yield strength of at least 830 MPa and elongation percentage of at least 7%. In other embodiments, the sintered Ti alloy may comprise 4 to 6 wt. % iron, 1 to 3 wt. % copper, 0.1 to 0.25 wt. % silicon, 0.05 to 0.21 wt. % boron, 0.2 to 0.49 wt. % lanthanum and the balance titanium with incidental impurities and have an ultimate tensile strength of at least 1000 MPa, yield strength of at least 830 MPa and elongation percentage of at least 8%.

Examples of specific sintered Ti alloy compositions of the present invention include Ti-4Fe-2.5Al-0.1Si-0.3$LaB_6$, Ti-5Fe-2.5Al-0.1Si-0.3$LaB_6$, Ti-5Fe-2.5Al-0.1Si-0.5$LaB_6$, Ti-5.5Fe-2.5Cu-0.1Si-0.3$LaB_6$, Ti-5.5Fe-2.5Cu-0.1Si-0.5$LaB_6$, Ti-5.5Fe-2.5Cu-0.1Si-0.5$LaB_6$, Ti-5.5Fe-2.5Al-0.1Si-0.3$LaB_6$, or Ti-5.5Fe-2.5Al-0.1Si-0.5$LaB_6$.

The present invention also relates to an article manufactured from the sintered titanium alloy according to the first aspect. The article can have any suitable form, including rod, plate, billet, or the like. The article is preferably produced as a near net or final shape of a product. It should be appreciated that the shape can have any configuration possible to be produced by a press-and-sinter method.

The alloy of the present invention can be formed using a powder metallurgy method, preferably a press-and-sinter method, using a blended powder mixture of alloying metal powders selected from master alloy powders, alloy mixture of elemental powders, or pre-alloyed titanium alloy powders with the other components of the powder blend. In some embodiments, the blended powder mixture comprises mixing titanium powder, elemental aluminium or copper powder, iron powder, silicon powder and $LaB_6$ powder. The inventors have found that providing the La and B content of the alloy as $LaB_6$ provides a unique oxygen scavenger for powder metallurgy titanium alloys which can scavenge the oxygen in titanium powder at temperatures below about 700° C. before the surface oxide films completely dissolve into the titanium matrix.

A wide range of suitable powders can be used for the blended powder mixture. In some embodiments, the titanium powder is preferably −100 to −500 mesh and at least 99 wt. %, preferably 99.5 wt. % purity. Furthermore, in embodiments each of the elemental aluminium powder, copper powder, iron powder, silicon powder and $LaB_6$ powder may be −325 mesh and at least 99 wt. %, preferably 99.5 wt. % purity. In exemplary embodiments, the powder mixes are: titanium powder (−100 to −500 mesh, 99.5 wt. % purity), elemental aluminium powder (−325 mesh, 99.5 wt. % purity), iron powder (−325 mesh, 99.5 wt. % purity), silicon powder (−325 mesh, 99.5 wt. % purity) and $LaB_6$ powder (−325 mesh, 99.5 wt. % purity).

A second aspect of the present invention provides a method of manufacturing the sintered titanium alloy similar to the first aspect using a blended elemental approach. In this second aspect, the present invention provides a process of producing of a sintered Ti—Fe—Al/Cu—Si—B—La alloy article comprising:

forming a blended powder mixture comprising mixing titanium powder, elemental aluminium or copper powder, iron powder, silicon powder and $LaB_6$ powder to provide an alloy blend comprising:

4 to 6 wt. % iron;

1 to 4 wt. % aluminium or 1 to 3 wt. % copper;

>0 to 0.5 wt. % silicon;

>0 to 0.3 wt. % boron;

>0 to 1 wt. % lanthanum, and the balance titanium with incidental impurities;

consolidating the blended powder mixture by compacting the powder blend using a powder consolidation method at a pressure in the range from 100 to 1100 MPa to provide a green compact;

heating the Ti green compact either in a protective atmosphere or under vacuum to a temperature over 1000° C. and holding the green compact at this temperature for at least 30 minutes, thereby sintering titanium to form a sintered compact; and cooling the sintered compact to form a sintered alloy article.

It should be appreciated that the sintered alloy product preferably comprises an alloy according to the first aspect of the present invention.

The second aspect manufactures titanium components by a blended elemental approach. In this approach, titanium and other elemental powders or a master alloy powder (e.g. 60Al-40V, wt. %) are used to produce the desired titanium alloy. This approach can be cheaper than other alloying methods, for example pre-alloyed methods, and typically results in competitive alloys. Using this method, titanium alloys of the present invention can be formed as powder metallurgy titanium alloys having a sintered density of greater than 95%, preferably greater than 98%, and more preferably at least 99% of theoretical density.

Importantly, at least a portion of La and B content of the alloy is added to the powder alloy composition as $LaB_6$. The inventors have found that $LaB_6$ provides a unique oxygen scavenger for powder metallurgy titanium alloys which can scavenge the oxygen in titanium powder at temperatures below about 700° C. before the surface oxide films completely dissolve into the titanium matrix. The process of this second aspect therefore utilises a powder composition that can control the detrimental influence of oxygen on the ductility of titanium alloys.

The process of the present invention can include a number of additional steps or processes depending on the composition and properties of the powder used in the blending powder mixture:

In some embodiments may further include the step after consolidating the powder blend of:

heating the green compact to a temperature ranging from 100° C. to 250° C. to release absorbed water from the titanium powder prior to sintering.

Furthermore, in those embodiments where the titanium powder of the blended powder mixture comprises hydrogenated titanium powder and the method preferably further includes the step of: refining said green compact by heating to 300 to 900° C. and holding the green compact at such temperatures for at least 30 minutes. The refining step removes impurities such as chlorine, magnesium, oxygen, and other impurities with hydrogen emitted through decomposition of titanium hydride in the green compact.

The blended powder mixture is preferably formed from the defined mixture of elemental powders. However, it should be appreciated in other methods the blended powder mixture may further comprise mixing alloying metal powders selected from master alloy powders, alloy mixture of elemental powders, and pre-alloyed titanium alloy powders with the other components of the powder blend.

The titanium powder used in the process of this second aspect is one which is generally called commercially pure titanium powder. Typical examples include (a) sponge fines as a by-product of sponge titanium, (b) hydride-dehydride titanium powder produced by hydrogenation, crushing, and dehydrogenation of sponge titanium, and (c) extra low chlorine titanium powder produced by melting sponge titanium for the removal of impurities, followed by hydrogenation, crushing, and dehydrogenation. However, in exemplary embodiments, titanium powder of the blended powder mixture comprises hydrogenated-dehydrogenated titanium powder, hydrogenated titanium powder or a mixture thereof.

Again, a wide range of suitable powders can be used for the blended powder mixture. In some embodiments, the titanium powder is preferably −100 to −500 mesh and at least 99 wt. %, preferably 99.5 wt. % purity. Furthermore, in embodiments each of the elemental aluminium powder, copper powder, iron powder, silicon powder and $LaB_6$ powder may be −325 mesh and at least 99 wt. %, preferably 99.5 wt. % purity. In exemplary embodiments, the powder mixes are: titanium powder (−100 to −500 mesh, 99.5 wt. % purity), elemental aluminium powder (−325 mesh, 99.5 wt. % purity), iron powder (−325 mesh, 99.5 wt. % purity), silicon powder (−325 mesh, 99.5 wt. % purity) and $LaB_6$ powder (−325 mesh, 99.5 wt. % purity).

The combined use of silicon and boron can be much more effective in the densification than the use of silicon and boron alone. Thus in some embodiments the elemental silicon and boron powders are either: premixed together prior to introduction into the blended powder; or introduced simultaneously into blended powder mixture. This blend or feeding regime can produce a high sintered density of powder metallurgy Ti alloy.

The powder consolidation method comprises a room temperature consolidation method selected from die pressing, cold isostatic pressing, impulse pressing, or combination thereof. The consolidation step pressure is preferably from 200 to 800 MPa.

A range of conditions can be used for the heating and sintering step. In some embodiments, the sintering temperature is from 1000° C. to 1400° C., preferably from 1250 to 1350° C. The green compact is preferably held at this temperature for at least 30 minutes, thereby sintering titanium to form a sintered compact. It is preferred that the sintering time can be from 2 to 50 hours, further from 4 to 16 hours. Furthermore, the Ti green compact preferably has a heating and cooling rate of at least 4° C./min. In some embodiments, the heating rate is preferably, at least 5° C./min. The green compact is preferably held at this temperature for a holding time ranging from about 10 min to about 360 min, wherein the holding time and a thickness of the green compact are such that there is about 18 min to about 24 min of holding time per every 6 mm of the thickness of the green compact. Sintering is also preferably conducted in a sintering environment of vacuum sintering ($10^{-2}$ to $10^{-4}$ Pa).

In some embodiments, the following combination of conditions are used:

compact pressure is in the range from 200 to 800 MPa;

sintering environment is vacuum sintering ($10^{-2}$ to $10^{-4}$ Pa);

isothermal sintering temperature is from 1250 to 1350° C. with heating and cooling of at least 4° C./min or faster.

The resulting sintered alloy article preferably has a sintered density of at least 95%, preferably at least 98%, more preferably at least 99% of theoretical density.

It should be appreciated that the produced sintered alloy article can undergo any number of secondary processing steps to improve the mechanical properties of that sintered alloy article. For example, following sintering the process could include a hot working step of hot-working a sintered billet obtained in the sintering step; a cold working step of cold-working the sintered billet, or other similar processes. In some embodiments, the cold-working step follows the hot working step.

In a third aspect, the present invention provides a new Ti—Fe—Al/Cu—Si—B—La alloy or sintered alloy article manufactured by a method according to the second aspect of the present invention.

BRIEF DESCRIPTION OF THE DRAWINGS

The present invention will now be described with reference to the figures of the accompanying drawings, which illustrate particular preferred embodiments of the present invention, wherein.

DETAILED DESCRIPTION

Figure 1:
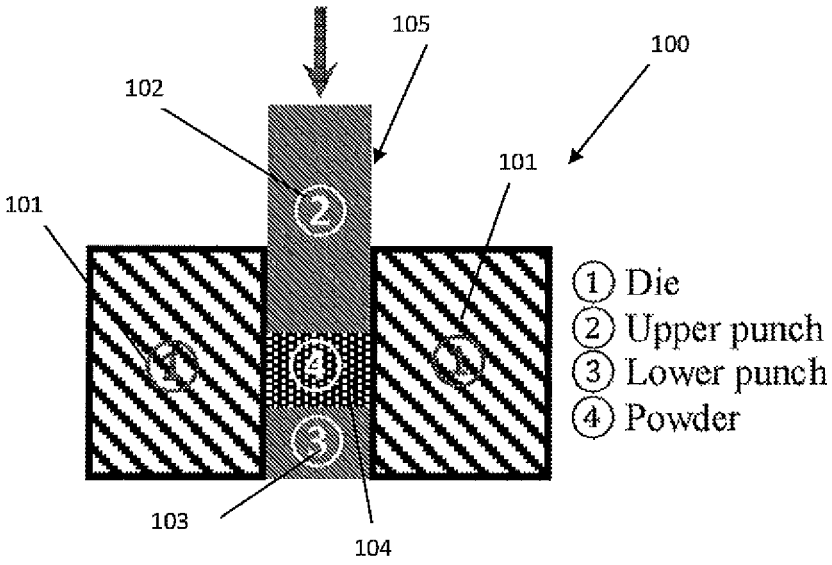
FIG. 1 shows a simple schematic of a conventional punch and die setup for press and sinter alloy formation.

The present invention relates to a powder metallurgy titanium-iron based alloy containing aluminium or copper, silicon, boron and lanthanum, preferably manufactured from titanium powder with elemental iron, aluminium or copper, and silicon powders and lanthanum boride ($LaB_6$) powder. The present invention relates to compositions of these new alloys, and the method of manufacturing utilising a powder composition which can control both the sintered density and the detrimental influence of oxygen on ductility.

With respect to alloy composition, the sintered powder metallurgy titanium alloy of the present invention generally comprises: 4 to 6 wt. % iron; 1 to 4 wt. % aluminium or 1 to 3 wt. % copper; >0 to 0.5 wt. % silicon; >0 to 0.3 wt. % boron; >0 to 1 wt. % lanthanum, and the balance being titanium with incidental impurities. The microstructure of the as-sintered alloy shows a typical homogenous microstructure consisting of α-Ti and β-Ti phases with TiB, $La_2O_3$ and $LaCl_xO_y$ phases.

In this composition, the sintered titanium alloy of the present invention should contain iron (Fe) in the amount of 4 to 6 wt. %. Iron is a low-cost alloying element available in its powder form. In addition, Ti—Fe intermediate alloys available from different sources can also be readily made into powder. Furthermore, low-cost titanium sponge containing a high level of iron is also readily available and such high iron-containing titanium sponge, which is often avoided for other applications due to their excessive iron content, can be used to make low-cost HDH titanium powder suited to the present invention. From a sintering perspective, densification of PM Ti alloys is dictated by the self-diffusion of Ti while the diffusion of alloying elements determines the subsequent microstructure formation [see references 3, 4]. Fe is a fast diffuser in both α-Ti and β-Ti. It favours the self-diffusion of the base titanium atoms and hence the sintering densification [see reference 5]. Another important consideration is that although Ti—Fe is a eutectoid system, it does not actually undergo eutectoid transformation even under slow furnace cooling conditions [see reference 6]. This avoids forming the brittle Ti—Fe eutectoid phase and therefore favours the development of ductile Ti—Fe based PM alloys [see reference 7]. Fe is a potent β-Ti stabilizer. Compared to other β-Ti stabilizers, Fe markedly lowers the solidus of the Ti—Fe alloys [see reference 5]. For instance, the solidus of Ti-5Fe is 1450° C. vs. 1600° C. for Ti-5Cr, 1640° C. for Ti-5V, 1685° C. for Ti-5Mo and 1670° C. for unalloyed Ti. This makes Ti—Fe based alloys more suited to solid state sintering. However, high Fe-containing titanium ingot alloys are yet to be well developed due to the segregation tendency of iron by the conventional ingot metallurgy route (limited to <2.5 wt. % Fe). Powder metallurgy Ti-1Al-8V-5Fe (wt. %) is an excellent example in this regard, which is one of the strongest Ti alloys developed to date, with yield strength reaching 1650 MPa. In addition, Fe-containing titanium alloys are heat treatable to provide a wide range of strengths.

The sintered titanium alloy of the present invention should also contain aluminium (Al) in the amount of 1 to 4 wt. %, or copper (Cu) in the amount of 1 to 3 wt. %. Aluminium and copper are added to improve the strength of the titanium alloys according to the present invention.

Aluminium is a widely used alloying element in Ti alloys and is a low cost α-Ti stabilizer. The use of Al improves the tensile yield strength and resistance to oxidation of unalloyed titanium. Al restrains the precipitation of an omega (ω) phase which increases the hardness of the titanium alloy by embrittlement during heat treatment, increases the strength and the ductility, and improves processability and castability.

The introduction of copper to unalloyed titanium offers the potential of precipitation strengthening by forming $Ti_2Cu$ precipitates. IMI 230 (Ti-2.5Cu) is one such commercial Ti alloy. From a sintering perspective, Ti and Cu and Fe and Cu may form low-melting point eutectic liquids (transient liquids) during heating to the isothermal sintering temperature when introduced as elemental powder mixes. In addition, the combined use of Cu and a small addition of silicon (Si) have the potential to change the precipitation sequence of titanium silicides. Thermo-Calc predictions indicate that the introduction of Cu could change the formation of titanium silicides from the less stable $Ti_3Si$ to the stable $Ti_5Si_3$. The melting point of $Ti_5Si_3$ is ~2130° C., which is a stable phase and offers the potential of strengthening while $Ti_3Si$ exists at temperatures below 1170° C. Finally, Cu powder is readily available and less expensive than Ti powder.

The sintered titanium alloy of the present invention should also contain silicon (Si) in the amount of >0 to 0.5 wt. %. Silicon (2.33 g/$cm^3$) is much lighter than titanium (4.51 g/$cm^3$) and also inexpensive. A small addition of silicon can markedly lower the solidus of the Ti—Fe base alloys [see reference 5]. In addition, it can lead to the transient liquid formation during sintering and enhance the densification [see reference 5]. Small additions of Si (≤1 wt. %) can improve the tensile properties of the as-sintered Ti alloy, including the ductility, with fine titanium silicides ($Ti_5Si_3$) being dispersed in both the α and β phases. Also, small additions of silicon to titanium alloys improve the resistance to creep and oxidation.

The sintered titanium alloy of the present invention should also contain boron (B) in an amount of greater than 0, and less than 0.3 wt. %. Boron is an effective sintering aid to powder metallurgy Ti alloys however small its amount may be [see reference 8]. Small additions of boron refine both the β-Ti and α-Ti phases and also noticeably change the morphology of α-Ti from laths to near equiaxed grains [see reference 9], beneficial to ductility. The formation of TiB particles inhibits the growth of β grains during sintering and promotes the heterogeneous nucleation of the α phase during cooling which follows sintering, with the result that the α-phase in the sintered body becomes nearly equiaxed. The presence of resulting TiB strengthens Ti alloys and could lead to improved fatigue properties as suggested by literature. The combined use of silicon and boron offers a better effect on the sintering densification and mechanical properties than each alone.

Finally, the sintered titanium alloy of the present invention should contain lanthanum (La) in an amount of greater than 0 to 1 wt. %. Lanthanum (La) is an available RE element which is useful in an oxygen scavenging role (RE) in powder metallurgy Ti alloys (see below).

Whilst not wishing to be limited to any one theory, the Inventors observe that previous effort in the use of the RE elements to control oxygen (O) in powder metallurgy Ti alloys was, however, focused on scavenging O from beta Ti solid solutions during isothermal sintering, i.e. after the surface titanium oxide film has completely dissolved into the Ti matrix [see references 10-13]. As a result, the oxygen-scavenging process is controlled by the diffusion of oxygen and is difficult to complete. On the other hand, the pick-up of O never stops during isothermal sintering which constantly offsets the effect of scavenging O. It is thus desirable to be able to scavenge the oxygen from the surface oxide films prior to their active dissolution into the underlying Ti metal. The approximate temperature beyond which the surface oxide films can actively dissolve into the underlying Ti metal is believed to be 700° C. [see reference 14].

Lanthanum (La) can be introduced together with boron (B) in the form of $LaB_6$. The inventors have found that $LaB_6$ provides a unique oxygen scavenger for powder metallurgy titanium alloys which can scavenge the oxygen in titanium powder before the surface oxide films completely dissolve into the titanium matrix. The present inventors have found that $LaB_6$ can readily react with the surface titanium oxide film on Ti powder from about 615° C. to form an initial layer of $LaBO_3$ before the oxide film actively dissolves into the underlying Ti metal. Subsequent scavenging of O occurs via the diffusion of O through the loose $LaBO_3$ layer until the temperature reaches about 1130° C., beyond which $LaBO_3$ decomposes into $La_2O_3$.

The incidental impurities or inevitable impurities are components possibly added in the raw material of the titanium alloy or during processing unintentionally. Particularly, oxygen may deteriorate the deformation capacity of the titanium alloy, may become a reason generating cracks during cold working, and may become a reason increasing a deformation resistance. Thus, the amount of the inevitable impurities is preferably maintained by less than or equal to 0.35 wt. % Carbon largely lowers the deformation capacity of the titanium alloy and so, is preferably included as small amount as possible. Preferably, the amount of the carbon is less than or equal to 0.1 wt. % and more preferably, the amount of the carbon is less than or equal to 0.05 wt. %. In addition, nitrogen also largely lowers the deformation capacity of the titanium alloy and so is required to be included as small amount as possible. Preferably, the amount of the nitrogen is less than or equal to 0.02 wt. % and more preferably, the amount of the nitrogen is less than or equal to 0.01 wt. %.

The as-sintered mechanical properties of these low cost new titanium alloys are suited to a wide range of demanding applications. The as-sintered alloy shows tensile properties which match the ASTM B381-10 standard specifications for Ti-6Al-4V forgings. The sintered Ti alloy typically has an ultimate tensile strength of at least 950 MPa, yield strength of at least 830 MPa and elongation percentage of at least 6%. In specific embodiments where the sintered Ti alloy comprises 4 to 6 wt. % iron, 1 to 4 wt. % aluminium, 0.1 to 0.25 wt. % silicon, 0.05 to 0.21 wt. % boron, 0.2 to 0.49 wt. % lanthanum and the balance titanium with incidental impurities, the resulting sintered alloy has an ultimate tensile strength of at least 950 MPa, yield strength of at least 830 MPa and elongation percentage of at least 6%. In other embodiments where the sintered Ti alloy comprises 4 to 6 wt. % iron, 1 to 3 wt. % copper, 0.1 to 0.25 wt. % silicon, 0.05 to 0.21 wt. % boron, 0.2 to 0.49 wt. % lanthanum and the balance titanium with incidental impurities, the resulting sintered alloy has an ultimate tensile strength of at least 1000 MPa, yield strength of at least 830 MPa and elongation percentage of at least 8%.

The present invention also provides a process of producing a sintered Ti—Fe—Al/Cu—Si—B—La alloy article. Specifically, the present production process comprises the steps of:

(1) forming a blended powder mixture comprising mixing titanium powder, elemental aluminium or copper powder, iron powder, silicon powder and $LaB_6$ powder;

(2) consolidating the powder mixture by compacting the powder mixture using a powder consolidation method at a pressure in the range from 100 to 1100 MPa, 200 to 800 MPa preferably to provide a green compact;

(3) heating the Ti green compact either in a protective atmosphere or under vacuum to a temperature over 1000° C., preferably from 1250° C. to 1350° C., and holding the green compact at this temperature for at least 30 minutes, thereby sintering titanium to form a sintered compact; and (4) cooling the sintered compact to form a sintered alloy article.

Each of these steps is described in more detail below:

Powder Mixing

The blended powder mixture can be formed using any suitable powder blending and/or mixing apparatus, system or arrangement. Suitable apparatus include a type "V" mixer, a ball mill and a vibration mill, a high-energy ball mill (for example, an attritor), or the like. The powder needs to have a relatively uniform blend throughout prior to compaction into the green compact.

Consolidation

The consolidation or compacting step can be carried out using any suitable compaction method including die pressing, direct powder rolling, cold isostatic pressing, impulse pressing, RIP compacting (rubber isostatic press compacting) or combination thereof. It should be appreciated that the shapes of compacted bodies can be final shapes of products or shapes close thereto, or even the shapes of billets being intermediate products, or the like.

One particular example shown in FIG. 1 is a schematic of a conventional punch and die apparatus 100 for powder compaction. It should be appreciated that other methods are equally applicable as noted above. The illustrated punch and die apparatus 100 includes a die 101, typically a solid block which includes a passage which received upper 102 and lower 103 sections of the punch 105. In the illustrated method, the powder 104 is placed between the upper 102 and lower 103 sections of the punch 105 and first pressed into a green compact at ambient temperature. Depending on the particle size, morphology and impurity level, the pressing pressure developed between the upper 102 and lower 103 sections of the punch 105 between the normally ranges from 100 to 1100 MPa, preferably 200 to 800 MPa.

Sintering

The Titanium green compact can be sintered either in a protective atmosphere or under vacuum at a high temperature. The sintering temperature is less than the liquidus temperatures of titanium alloys. The sintering temperature is preferably from 1000 to 1350° C., yet more preferably from 1250 to 1350° C. The green compact is held at this temperature for at least 30 minutes, thereby sintering titanium to form a sintered compact. It is preferred that the sintering time can be from 2 to 50 hours, further from 4 to 16 hours.

The sintered compact is thereafter cooled, typically in the furnace.

A number of ranges can be used for the sintering process of this manufacturing method. In some embodiments, the following conditions are used:

sintering environment is vacuum sintering ($10^{-2}$ to $10^{-4}$ Pa); and isothermal sintering temperature is from 1250 to 1350° C. with heating and cooling at about 4° C./min or faster.

Powders

As the raw material powder, it is possible to use sponge powders, hydrogenated-and-dehydrogenated powders, hydrogenated powders, and the like. The titanium powder used in this method is one which is generally called commercially pure titanium powder. Its typical examples include hydride-dehydride titanium powder produced by hydrogenation, crushing, and dehydrogenation of Kroll sponge titanium, and extra low chlorine titanium powder produced by melting Kroll sponge titanium for the removal of impurities, followed by hydrogenation, crushing, and dehydrogenation.

In some embodiments, the process uses hydrogenated-dehydrogenated (HDH) titanium powder or hydrogenated titanium powder. In preferred forms, the titanium powder is hydrogenation-dehydrogenation (HDH) titanium powder. It should be appreciated that the hydrogenation-dehydrogenation (HDH) process is a well-established method of forming titanium powder. The process is based on the reaction of titanium, typically titanium sponge from the Kroll process, with hydrogen at 350 to 700° C. to form hydrides (titanium hydride ($TiH_2$)). The hydrogenated titanium is brittle and can be ground into a fine powder using mechanical comminution methods such as ball milling, jet milling, wet milling or the like. The ground titanium hydride is subsequently dehydrogenated at 700 to 900° C. for 1 to 2 hours, preferable under reduced pressure or vacuum conditions to form a titanium powder-form product. A saturation of titanium by hydrogen achieves 2 to 3.5 wt. % depending on the purity of the initial material.

The particulate shapes and particle diameters (particle diameter distributions) of the powders are not limited in particular, but it is possible to use commercially available powders. Indeed, when the average particle diameter is 100 μm or less, dense sintered bodies can be obtained. Moreover, the raw material powder can be mixture powders in which elemental powders are mixed, or alloy powders which have desired compositions. A wide range of suitable powders can be used for the blended powder mixes. In exemplary embodiments, the powder mixes are: titanium powder (−100 to −500 mesh, 99.5 wt. % purity), elemental aluminium powder (−325 mesh, 99.5 wt. % purity), iron powder (−325 mesh, 99.5 wt. % purity), silicon powder (−325 mesh, 99.5 wt. % purity) and $LaB_6$ powder (−325 mesh, 99.5 wt. % purity).

As discussed above, lanthanum boride/lanthanum hexaboride ($LaB_6$) is provided in the blended powder mixture to provide some if not all of the La and B required for the alloy. B from $LaB_6$ improves sintering density as discussed above. However, the inventors have also found that $LaB_6$ provides a unique oxygen scavenger for this titanium alloy which can scavenge the oxygen in titanium powder before the surface oxide films completely dissolve into the titanium matrix. $LaB_6$ comprises an effective oxygen scavenger for powder metallurgy titanium alloys, which can scavenge the oxygen in titanium powder at temperatures below about 700° C., before the surface oxide film dissolves into the underlying titanium matrix. $LaB_6$ can readily react with the surface titanium oxide film on Ti powder from about 615° C. to form an initial layer of $LaBO_3$ before the oxide film actively dissolves into the underlying Ti metal. Subsequent scavenging of oxygen (O) occurs via the diffusion of O through the loose $LaBO_3$ layer until the temperature reaches about 1130° C., beyond which $LaBO_3$ decomposes into $La_2O_3$.

It has been reported in Yang, Y. F., Luo, S. D., et al. (2014). "The effect of lanthanum boride on the sintering, sintered microstructure and mechanical properties of titanium and titanium alloys." Materials Science and Engineering A-Structural Materials Properties Microstructure and Processing 618: 447-455 that additions of ≤0.5 wt. % $LaB_6$ also improve tensile elongation attributable mainly to the scavenging of oxygen by $LaB_6$, and partially assisted by the improved sintered density, an addition of >0.5 wt. % $LaB_6$ led to the formation of large $La_2O_3$ aggregates and more brittle TiB whiskers and therefore decreased tensile elongation. Balanced scavenging of O is thus important.

EXAMPLES

Example I: The Sintered Density, Microstructure, and Tensile Properties of Ti-5Fe-2.5Al-0.1Si-0.3$LaB_6$, Ti-5Fe-2.5Al-0.1Si-0.5$LaB_6$, Ti-5.5Fe-2.5Al-0.1Si-0.3$LaB_6$ and Ti-5.5Fe-2.5Al-0.1Si-0.5$LaB_6$ Fabricated Using HDH Ti Powder, $LaB_6$ Powder and Elemental Powders HDH titanium powder (−250 mesh, ≤63 μm, 99.5 wt. % purity, 0.25 wt. % O), elemental iron powder (≤45 μm, 99.5 wt. % purity), aluminium powder (99.7 wt. % purity, ~3 μm), silicon powder (≤45 μm, 99.5 wt. % purity) and $LaB_6$ powder (99.7 wt. % purity, ~3 μm) were used. Powder mixes of Ti-5Fe-2.5Al-0.1Si-0.3$LaB_6$, Ti-5Fe-2.5Al-0.1Si-0.5$LaB_6$, Ti-5.5Fe-2.5Al-0.1Si-0.3$LaB_6$ and Ti-5.5Fe-2.5Al-0.1Si-0.5$LaB_6$ were prepared in a Turbula mixer for 30 min. The elemental powder mixes were compacted uniaxially at 600 MPa in a floating die into either samples of 10 mm in both diameter and height for microstructural characterisation or tensile bars of 56 mm×11 mm×4.5 mm for mechanical testing. Sintering was conducted at 1350° C.

for 120 min in a tube furnace under a vacuum of $10^{-2}$-$10^{-3}$ Pa, with heating and cooling both at 4° C./min. The sintered density was measured by the Archimedes method following the ASTM standard B328. Tensile specimens (3 mm×4.5 mm cross-section and 15 mm gauge length) were machined from as-sintered bars and tested on an Instron screw machine (Model 5054, USA) with a cross head speed of 0.5 mm/min.

Figure 2:
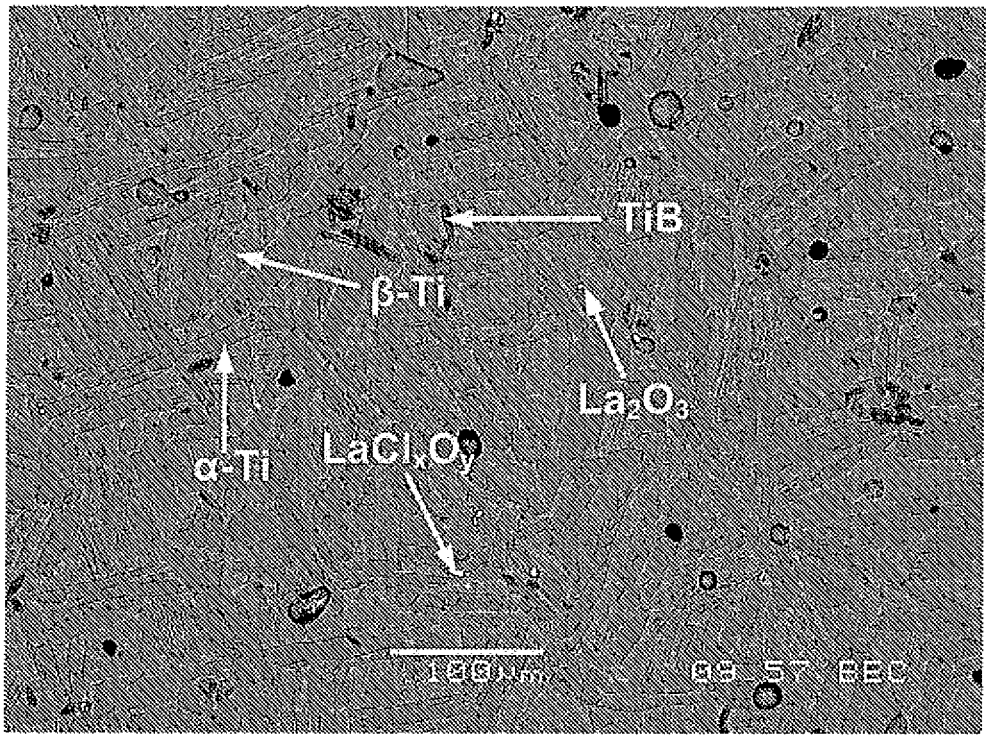
FIG. 2 shows the as-sintered microstructures of Ti-5.5Fe-2.5Al-0.1Si-0.3$LaB_6$ fabricated using HDH Ti powder and elemental powders after 120 min at 1350° C. in vacuum.

Table 1 shows the sintered density after sintering at 1350° C. for 120 min. The sintered density achieved 98.4% of theoretical density after sintering at 1350° C. for 120 min, as shown in Table I. The as-sintered microstructure of Ti-5.5Fe-2.5Al-0.1Si-0.3$LaB_6$ consists of α-Ti, β-Ti, TiB, $La_2O_3$ and $LaCl_xO_y$ particles, as shown in FIG. 2. The α-Ti phase is dark grey while β-Ti phase is light grey. The short-fibre or whisker in black is TiB. White spherical particle is $La_2O_3$ while short fibre is $LaCl_xO_y$. The ultimate tensile strength of as-sintered sample is 1063 MPa, yield strength is 930 MPa and tensile elongation is 7.8%. For comparison, Table I has also listed the ASTM B381-10 standard specifications for Ti-6Al-4V forgings.

TABLE I

Density and tensile mechanical properties of as-sintered Ti—5Fe—2.5Al—0.1Si—0.3$LaB_6$, Ti—5Fe—2.5Al—0.1Si—0.5$LaB_6$, Ti—5.5Fe—2.5Al—0.1Si—0.3$LaB_6$ and Ti—5.5Fe—2.5Al—0.1Si—0.5$LaB_6$ fabricated using HDH Ti powder and elemental powders and ASTM B381-10 standard specifications for Ti—6Al—4V forgings. Sintering was performed at 1350° C. for 120 min in vacuum.

| Materials | Relative sintered density (%) | Ultimate tensile strength (MPa) | Yield strength (MPa) | Elongation (%) |
|---|---|---|---|---|
| Ti—5Fe—2.5Al—0.1Si—0.3$LaB_6$ | 97.8 | 962 | 854 | 7.0 |
| Ti—5Fe—2.5Al—0.1Si—0.5$LaB_6$ | 98.1 | 985 | 867 | 7.2 |
| Ti—5.5Fe—2.5Al—0.1Si—0.3$LaB_6$ | 98.4 | 1063 | 930 | 7.8 |
| Ti—5.5Fe—2.5Al—0.1Si—0.5$LaB_6$ | 98.1 | 1081 | 938 | 7.6 |
| ASTM B381-10 | 100 | 895 | 828 | 10 |

Example II: The Sintered Density, Microstructure, and Tensile Properties of Ti-5.5Fe-2.5Al-0.1Si-0.3$LaB_6$ Fabricated Using Titanium Hydride Powder, $LaB_6$ Powder and Elemental Powders Titanium hydride powder (−100 mesh, ≤150 μm, 99.5 wt. % purity, 0.2 wt. % O), elemental iron powder (≤45 μm, 99.5 wt. % purity), aluminium powder (99.7 wt. % purity, ~3 μm), silicon powder (≤45 μm, 99.5 wt. % purity) and $LaB_6$ powder (99.7 wt. % purity, ~3 μm) were used. Powder mixes of Ti-5.5Fe-2.5Al-0.1Si-0.3$LaB_6$ were prepared in a Turbula mixer for 120 min. The elemental powder mixes were compacted uniaxially at 600 MPa in a floating die into either samples of 10 mm in both diameter and height for microstructural characterisation or tensile bars of 60 mm×12 mm×5 mm for mechanical testing. Sintering was conducted at 1300° C. for 120 min in a furnace under a vacuum of $10^{-3}$-$10^{-4}$ Pa, with heating and cooling both at 4° C./min. But during heating from 400 to 800° C., the heating rate decreased to 1° C./min to remove the hydrogen from titanium hydride. The sintered density was measured by the Archimedes method following the ASTM standard B328. Tensile specimens (3 mm×4.5 mm cross-section and 15 mm gauge length) were machined from as-sintered bars and tested on an Instron screw machine (Model 5054, USA) with a cross head speed of 0.5 mm/min.

Figure 3:
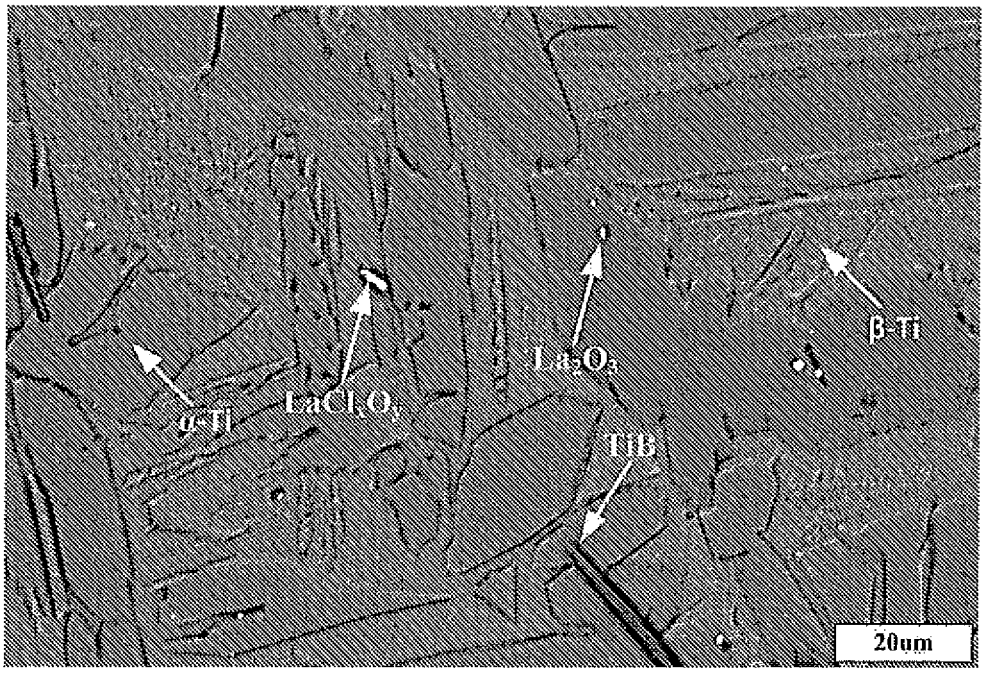
FIG. 3 shows an as-sintered microstructure of Ti-5.5Fe-2.5Al-0.1Si-0.3$LaB_6$ fabricated using titanium hydride powder and elemental powders after 120 min at 1350° C. in vacuum.

The sintered density achieved 99.6% of theoretical density after sintering at 1300° C. for 120 min, as shown in Table II. The as-sintered microstructure is same to that obtained by using HDH titanium powder, consisting of α-Ti, β-Ti, TiB, $La_2O_3$ and $LaCl_xO_y$ particles, as shown in FIG. 3.

TABLE II

Density and tensile mechanical properties of as-sintered Ti—5.5Fe—2.5Al—0.1Si—0.3$LaB_6$ fabricated using titanium hydride powder, $LaB_6$ powder and elemental powders.

| Materials | Relative sintered density (%) | Ultimate tensile strength (MPa) | Yield strength (MPa) | Elongation (%) |
|---|---|---|---|---|
| Ti—5.5Fe—2.5Al—0.1Si—0.3$LaB_6$ | 99.6 | 1070 | 935 | 7.45 |

The ultimate tensile strength of as-sintered sample was 1070 MPa, yield strength was 935 MPa and tensile elongation was 7.45%.

Example III: The Sintered Density, Microstructure, and Tensile Properties of Ti-5.5Fe-2.5Cu-0.1Si-0.3/0.5$LaB_6$ Fabricated Using HDH Ti Powder and Elemental Powders Replacing Al with Cu can be a potential option. Table III lists the results obtained from the as-sintered Ti-5Fe-2.5Cu-0.1Si-0.3/0.5$LaB_6$ and Ti-5.5Fe-2.5Cu-0.1Si-0.3/0.5$LaB_6$ alloys under the same compaction and sintering conditions described in Example I. Compared to the as-sintered Ti-5.5Fe-2.5Al-0.1Si-0.3$LaB_6$, both the ultimate tensile strength and yield strength become lower while the tensile elongation is greater.

TABLE III

Density and tensile mechanical properties of as-sintered Ti—5Fe—2.5Cu—0.1Si—0.3/0.5$LaB_6$, Ti—5.5Fe—2.5Cu—0.1Si—0.3/0.5$LaB_6$ and ASTM B381-10 standard specifications for Ti—6Al—4V forgings. Sintering was performed at 1350° C. for 120 min in vacuum.

| Materials | Relative sintered density (%) | Ultimate tensile strength (MPa) | Yield strength (MPa) | Elongation (%) |
|---|---|---|---|---|
| Ti—5Fe—2.5Cu—0.1Si—0.3$LaB_6$ | 96.8 | 976 | 830 | 7.1 |
| Ti—5Fe—2.5Cu—0.1Si—0.5$LaB_6$ | 97.1 | 998 | 837 | 7.5 |
| Ti—5.5Fe—2.5Cu—0.1Si—0.3$LaB_6$ | 97.6 | 1022 | 865 | 8.6 |
| Ti—5.5Fe—2.5Cu—0.1Si—0.5$LaB_6$ | 98.3 | 1047 | 877 | 9.4 |
| ASTM B381-10 | 100 | 895 | 828 | 10 |

Example IV: Comparison of the Combined Use of Silicon and Boron with the Use of Silicon or Boron Alone for Sintered Density Four compositions, Ti-5Fe-2.5Al, Ti-5Fe-2.5Al-0.25Si, Ti-5Fe-2.5Al-0.1B and Ti-5Fe-2.5Al-0.25Si-0.1B, were used to compare the effect of the use of combined silicon and boron. Elemental amorphous boron powder (92 wt. % purity, <1 μm) was used. Other powders are same as those used in Example I. Sintering was conducted at 1350° C. for 120 min in a tube furnace under a vacuum of $10^{-2}$-$10^{-3}$ Pa, with heating and cooling both at 4° C./min. Table IV lists the results.

TABLE IV

Comparison of the combined use of Si and B versus the use of Si or B alone. Sintering was conducted at 1350° C. for 120 min in vacuum.

| Materials | Relative sintered density (%) |
|---|---|
| Ti—5Fe—2.5Al | 93.5 |
| Ti—5Fe—2.5Al—0.25Si | 95.4 |
| Ti—5Fe—2.5Al—0.1B | 96.1 |
| Ti—5Fe—2.5Al—0.25Si—0.1B | 99.4 |

The sintered density of Ti-5Fe-2.5Al-0.25Si was 95.4% of theoretical density; the sintered density of Ti-5Fe-2.5Al-0.1B was 96.1% of theoretical density and the sintered density of Ti-5Fe-2.5Al-0.25Si-0.1B was 99.4% of theoretical density. The effectiveness of the combined use of silicon and boron is significant compared to the use of silicon or boron alone. The mechanism can be understood using Thermo-Calc calculations; the combined use of Si and B is much more effective in lowering the solidus temperature than the use of Si or B alone.

Example V: Optimization of the Iron Content

The compositions of Ti-3Fe-2.5Al-0.1Si-0.3$LaB_6$, Ti-4Fe-2.5Al-0.1Si-0.3$LaB_6$, Ti-5Fe-2.5Al-0.1Si-0.3$LaB_6$, Ti-5.5Fe-2.5Al-0.1Si-0.3$LaB_6$ and Ti-7Fe-2.5Al-0.1Si-0.3$LaB_6$ were employed to produce a comparison of the effect of iron content on the sintered density. Powders are the same as those used in Example I. Sintering was conducted at 1350° C. for 120 min in a tube furnace under a vacuum of $10^{-2}$-$10^{-3}$ Pa, with heating and cooling both at 4° C./min. Table V lists the results.

TABLE V

Effect of iron on the sintered density of Ti—$x$Fe—2.5Al—0.1Si—0.3$LaB_6$

| Materials | Relative sintered density (%) |
|---|---|
| Ti—3Fe—2.5Al—0.1Si—0.3$LaB_6$ | 93.1 |
| Ti—4Fe—2.5Al—0.1Si—0.3$LaB_6$ | 96.6 |
| Ti—5Fe—2.5Al—0.1Si—0.3$LaB_6$ | 97.8 |
| Ti—5.5Fe—2.5Al—0.1Si—0.3$LaB_6$ | 98.4 |
| Ti—7Fe—2.5Al—0.1Si—0.3$LaB_6$ | 92.6 |

The sintered densities of Ti-3Fe-2.5Al-0.1Si-0.3$LaB_6$, Ti-4Fe-2.5Al-0.1Si-0.3$LaB_6$, and Ti-5.5Fe-2.5Al-0.1Si-0.3$LaB_6$ reached 93.1%, 96.6% and 98.4% of theoretical density, respectively. However, the sintered density of Ti-7Fe-2.5Al-0.1Si-0.3$LaB_6$ decreased to 92.6% of theoretical density. The optimal iron content is thus determined to be in the range of 4-6 wt. %.

Example VI: A Unique Scavenger of Oxygen—$LaB_6$

The basic powder materials are the same as those used in Example I. To investigate the reaction between $LaB_6$ and the surface titanium oxide on titanium powder particles, nanometric $TiO_2$ powder (99.5 wt. % purity, 21 nm) was also used.

Figure 4:
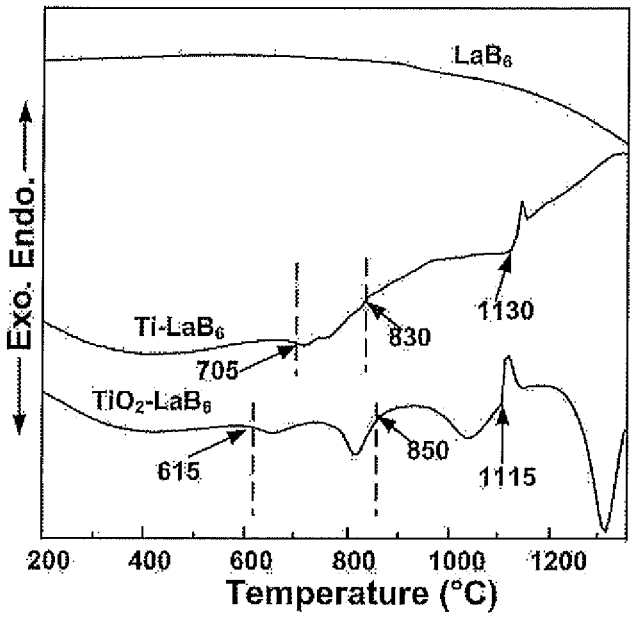
FIG. 4 shows the differential scanning calorimetry (DSC) curves of $LaB_6$ powder, Ti—$LaB_6$ powder blend (mole ratio: 1:1) and $TiO_2$—$LaB_6$ powder blend (mole ratio: 1:1) during heating to 1350° C. at 10° C./min in flowing high purity argon.

$LaB_6$ is stable at room temperature and also detected in Ti—$LaB_6$ powder mixtures during heating to 1350° C. (see FIG. 5). Experimental observations revealed that the scavenging of O by $LaB_6$ began by forming an interfacial $LaBO_3$ layer through $LaB_6$ reacting with the surface titanium oxide film on the Ti powder, see FIG. 6. DSC characterisation of the $LaB_6$—$TiO_2$ powder mixture confirmed that $TiO_2$ started to react with $LaB_6$ at about 615° C. (see FIG. 4), well before the temperature (700° C.) at which the surface titanium oxide film starts to actively dissolve into the underlying Ti metal. The exothermic event detected by DSC from 705° C. to 830° C. for the powder mixture of Ti and $LaB_6$ (see FIG. 4) is indicative of the actual reaction between the $LaB_6$ particles and the surface titanium oxide films of Ti particles. The ending temperature of 830° C. marks the disappearance of the surface titanium oxide film due to the consumption by $LaB_6$ and also its dissolution into the Ti matrix.

Figure 5:
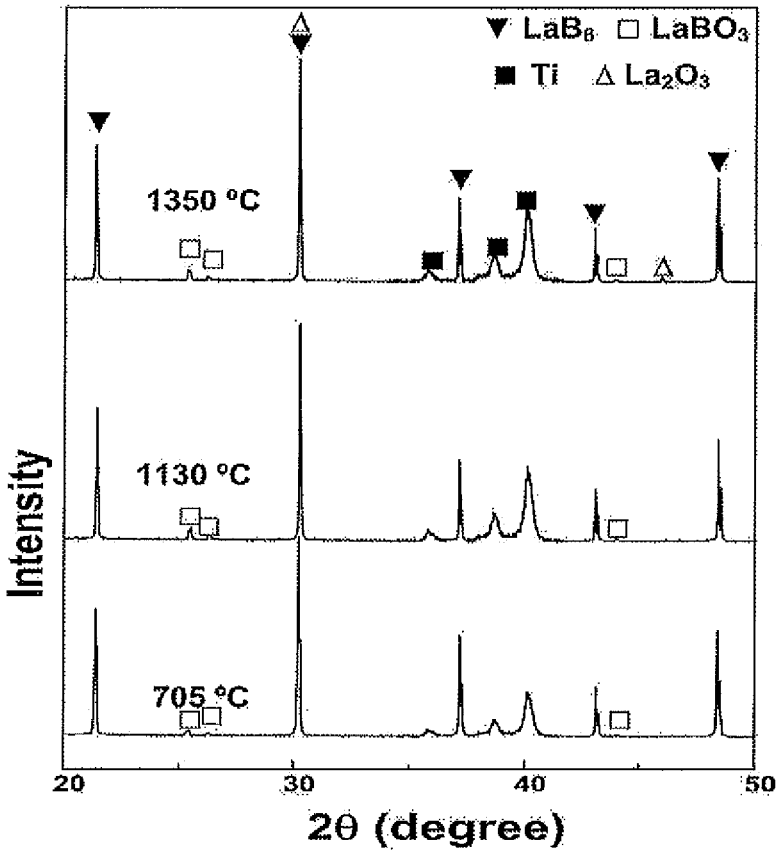
FIG. 5 shows x-ray diffraction (XRD) patterns of the Ti—$LaB_6$ DSC samples interrupted at 705° C., 1130° C. and 1350° C. during heating.
Figure 6:
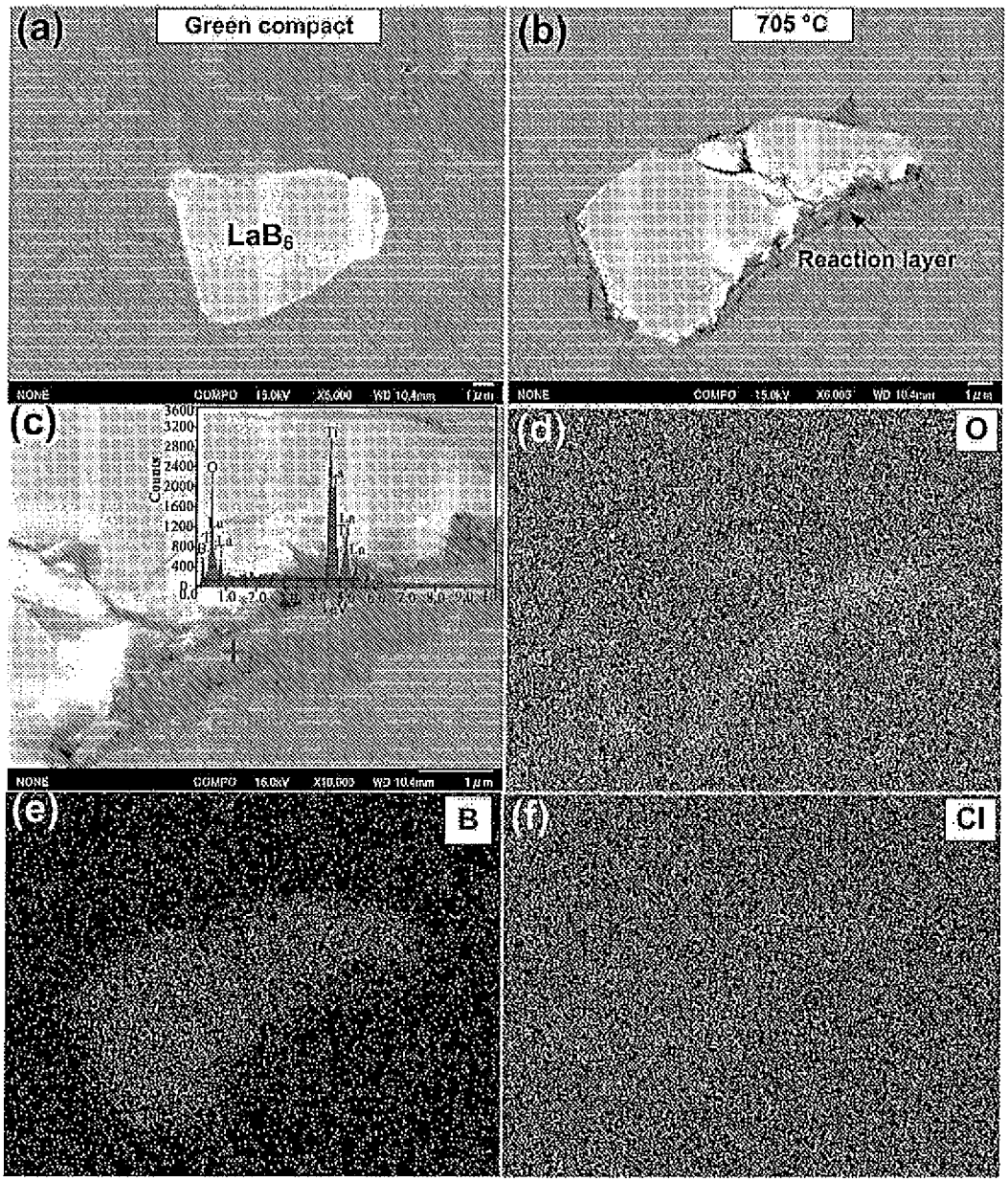
FIG. 6 provides (a) Scanning electron microscopy (SEM) backscattered electron (BSE) image of a $LaB_6$ particle in a Ti-1.0 wt. % $LaB_6$ green compact; (b) after being heated to 705° C.; (c) an enlarged view of (b) and energy-dispersive spectrometry (EDS) spot analysis of the interfacial layer; and (d), (e) and (f) are EDS mapping results of O, B and Cl, respectively, for the microstructure shown in (b).

XRD results of the Ti—$LaB_6$ DSC samples interrupted at 705° C., 1130° C. and 1350° C. showed the presence of $LaBO_3$, FIG. 5. Corresponding to the DSC results, a thin interfacial layer was observed surrounding each $LaB_6$ particle examined after being heated to 705° C., see FIG. 6(*b*). EDS results revealed that the interfacial layer is enriched with La, O and B, see FIGS. 6(*c*)-(*f*). The interfacial layer was thus concluded to be $LaBO_3$ in conjunction with the XRD results, see FIG. 5.

Figure 7:
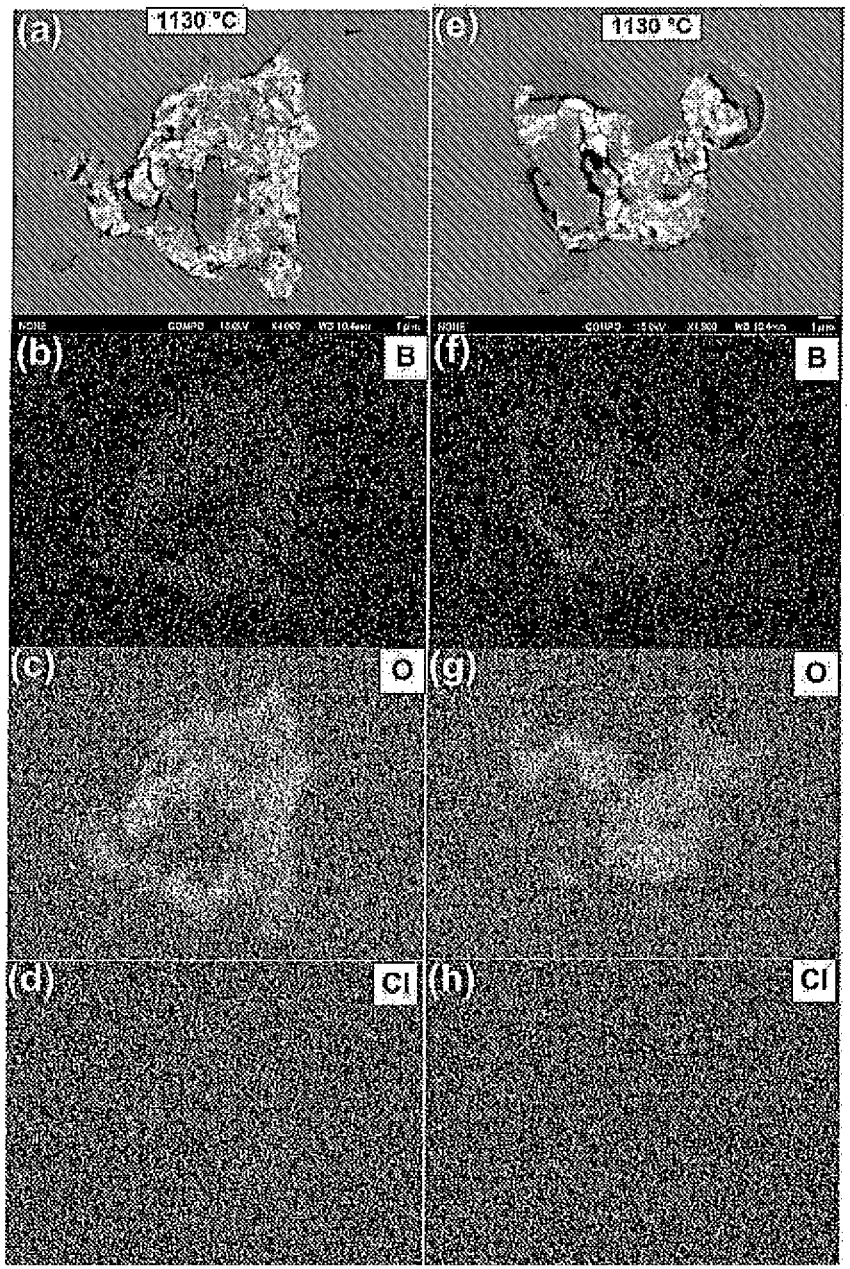
FIG. 7 shows (a) and (e): SEM BSE images of $LaB_6$ particles in Ti-1.0 wt. % $LaB_6$ samples heated to 1130° C. at 4° C./min without an isothermal hold; and Images of (b)-(d) and (f)-(h) are corresponding EDS mapping results.

Subsequent scavenging of O occurred via the diffusion of O from α-Ti below 882° C. while from β-Ti above 882° C. through the loose $LaBO_3$ layer. Owing to the increased temperature and faster diffusivity of O in β-Ti, the $LaB_6$ particles can quickly transform into $LaBO_3$ or non-stoichiometric La-, O- and B-enriched compounds by 1130° C. FIG. 7 shows two such examples.

The markets for this invention may comprise markets in which titanium components or parts are suitable to replace parts made from alternative materials/metals for light weighting or improved corrosion resistance or other properties. Potential markets for this invention are to replace the markets for a variety of stainless steel and copper parts.

Those skilled in the art will appreciate that the invention described herein is susceptible to variations and modifications other than those specifically described. It is understood that the invention includes all such variations and modifications which fall within the spirit and scope of the present invention.

Where the terms "comprise", "comprises", "comprised" or "comprising" are used in this specification (including the claims) they are to be interpreted as specifying the presence of the stated features, integers, steps or components, but not precluding the presence of one or more other feature, integer, step, component or group thereof.

REFERENCES

[1] M. Yan, M. S. Dargusch, T. Ebel, M. Qian, "Transmission electron microscopy and 3D atom probe study of oxygen-induced fine microstructural features in as-sintered Ti-6Al-4V and their impacts on ductility", Acta Materialia, 2014, 68, 196-206.

[2] M. Yan, W. Xu, M. S. Dargusch, H. P. Tang, M. Brandt, M. Qian, "Review of effect of oxygen on room temperature ductility of titanium and titanium alloys", Powder Metallurgy, 2014, 57, 251-257.

[3] Y. F. Yang, S. D. Luo, G. B. Schaffer, M. Qian, "Sintering of Ti-10V-2Fe-3Al and Mechanical Properties", Materials Science and Engineering A, 2011, 528, 6719-6726.

[4] Y. Xia, G. B. Schaffer, M. Qian, "Cobalt-doped Ti-48Al-2Cr-2Nb alloy fabricated by cold compaction and pressureless sintering", Materials Science and Engineering A, 2013, 574, 176-185.

[5] Y. F. Yang, S. D. Luo, G. B. Schaffer, M. Qian, "The sintering, sintered microstructure and mechanical properties of Ti—Fe—Si alloys", Metallurgical and Materials Transactions A, 2012, 43A, 4896-4906.

[6] B.-Y. Chen, K.-S. Hwang, K.-L. Ng, "Effect of cooling process on the a phase formation and mechanical properties of sintered Ti—Fe alloys", Materials Science and Engineering A, 2011, 528, 4556-4563.

[7] M. Qian, Y. F. Yang, M. Yan, S. D. Luo, "Design of low cost high performance powder metallurgy titanium alloys: some basic considerations", Key Engineering Materials, 2012, 520, 24-29.

[8] S. D. Luo, Y. F. Yang, G. B. Schaffer, M. Qian, "The effect of a small addition of boron on the sintering densification, microstructure and mechanical properties of powder metallurgy Ti-7Ni alloy", Journal of Alloys and Compounds, 2013, 555, 339-346.

[9] Y. F. Yang, M. Yan, S. D. Luo. G. B. Schaffer, M. Qian, "Modification of the α-Ti laths to near equiaxed α-Ti grains in as-sintered titanium and titanium alloys by a small addition of boron", Journal of Alloys and Compounds, 2013, 579, 553-557.

[10] Y. Liu, Y. Liu, B. Wang, J. Qiu, B. Liu, H. Tang, Microstructures evolution and mechanical properties of a powder metallurgical titanium alloy with yttrium addition. *Materials and Manufacturing Processes,* 2010, 25(8), 735-739.

[11] Y. Liu, Y. B. Liu, B. Wang, H. P. Tang, Rare Earth Element: Is it a Necessity for PM Ti Alloys?, *Key Engineering Materials,* 2012, 520, 41-48.

[12] M. Yan, Y. Liu, G. B. Schaffer, M. Qian, "In-situ synchrotron radiation to understand the pathways for the scavenging of oxygen in commercially-pure Ti and Ti-6Al-4V by yttrium hydride", Scripta Materialia, 2013, 68, 63-66.

[13] M. Yan, Y. Liu, Y. B. Liu, C. Kong, G. B. Schaffer, M. Qian, Simultaneous gettering of oxygen and chlorine and homogenization of the β phase by rare earth hydride additions to a powder metallurgy Ti-2.25Mo-1.5Fe alloy, Scripta Materialia, 2012, 67, 491-494.

[14] M. Qian, "Cold compaction and sintering of titanium and its alloys for near-net-shape or preform fabrication", International Journal of Powder Metallurgy, 2010, 46, No. 5, 29-44.

The invention claimed is:

1. A sintered Ti alloy consisting of:
4 to 6 wt. % iron;
1 to 4 wt. % aluminium or 1 to 3 wt. % copper;
>0 to 0.25 wt. % silicon;
>0 to 0.3 wt. % boron;
>0 to 1 wt. % lanthanum, and
the balance being titanium with incidental impurities,
wherein the sintered Ti alloy has an ultimate tensile strength of at least 900 MPa, a yield strength of at least 800 MPa, and an elongation percentage of at least 6%.

2. The sintered Ti alloy according to claim 1, wherein the sintered Ti alloy consists of 4 to 6 wt. % iron; 1 to 4 wt. % aluminium or 1 to 3 wt. % copper; 0.05 to 0.25 wt. % silicon; 0.05 to 0.3 wt. % boron; 0.1 to 1 wt. % lanthanum, and the balance titanium with incidental impurities.

3. The sintered Ti alloy according to claim 1, wherein the sintered Ti alloy consists of 4 to 6 wt. % iron; 2 to 4 wt. % aluminium or 2 to 3 wt. % copper; 0.1 to 0.25 wt. % silicon; 0.09 to 0.21 wt. % boron; 0.2 to 0.49 wt. % lanthanum, and the balance titanium with incidental impurities.

4. The sintered Ti alloy according to claim 1, wherein the sintered Ti alloy consists of 4 to 6 wt. % iron, 1 to 4 wt. % aluminium, 0.1 to 0.25 wt. % silicon, 0.09 to 0.21 wt. % boron, 0.2 to 0.49 wt. % lanthanum, and the balance titanium with incidental impurities, and wherein the sintered Ti has an ultimate tensile strength of at least 950 MPa, yield strength of at least 830 MPa and elongation percentage of at least 7%.

5. The sintered Ti alloy according to claim 1, wherein the sintered Ti alloy consists of 4 to 6 wt. % iron, 1 to 3 wt. % copper, 0.1 to 0.25 wt. % silicon, 0.09 to 0.21 wt. % boron, 0.2 to 0.49 wt. % lanthanum, and the balance titanium with incidental impurities, and wherein the sintered Ti has an ultimate tensile strength of at least 1000 MPa, yield strength of at least 830 MPa and elongation percentage of at least 8%.

6. The sintered Ti alloy according to claim 1, wherein the sintered Ti alloy is selected from the group consisting of: Ti-4Fe-2.5Al-0.1Si-0.3$LaB_6$, Ti-5Fe-2.5Al-0.1Si-0.3$LaB_6$, Ti-5Fe-2.5Al-0.1Si-0.5$LaB_6$, Ti-5.5Fe-2.5Cu-0.1Si-0.3$LaB_6$, Ti-5.5Fe-2.5Cu-0.1Si-0.5$LaB_6$, Ti-5.5Fe-2.5Al-0.1Si-0.3$LaB_6$, and Ti-5.5Fe-2.5Al-0.1Si-0.5$LaB_6$.

7. The sintered Ti alloy according to claim 1, wherein the sintered Ti alloy has a microstructure comprising α-Ti, β-Ti, TiB, $La_2O_3$ and $LaCl_xO_y$ phases.

8. An article manufactured from the sintered titanium Ti alloy according to claim 1.

9. A sintered alloy article, formed from a process comprising the steps of:

forming a blended powder mixture comprising mixing titanium powder, elemental aluminium or copper powder, iron powder, silicon powder and $LaB_6$ powder to provide an alloy blend consisting of:

4 to 6 wt. % iron;

1 to 4 wt. % aluminium or 1 to 3 wt. % copper;

>0 to 0.25 wt. % silicon;

>0 to 0.3 wt. % boron;

>0 to 1 wt. % lanthanum, and the balance being titanium with incidental impurities;

consolidating the blended powder mixture by compacting the powder mixes using a powder consolidation method at a pressure in the range from 100 to 1100 MPa to provide a green compact;

heating the Ti green compact either in a protective atmosphere or under vacuum to a temperature over 1000° C. and holding the green compact at this temperature for at least 30 minutes, thereby sintering titanium to form a sintered compact; and cooling the sintered compact to form a sintered alloy article, wherein the sintered alloy has an ultimate tensile strength of at least 900 MPa, a yield strength of at least 800 MPa, and an elongation percentage of at least 6%.

10. A process of producing a sintered Ti alloy article comprising:

forming a blended powder mixture comprising mixing titanium powder, elemental aluminum or copper powder, iron powder, silicon powder and $LaB_6$ powder to provide an alloy blend consisting of:

4 to 6 wt. % iron;

1 to 4 wt. % aluminium or 1 to 3 wt. % copper;

>0 to 0.25 wt. % silicon;

>0 to 0.3 wt. % boron;

>0 to 1 wt. % lanthanum, and the balance being titanium with incidental impurities;

consolidating the blended powder mixture by compacting the powder mixture using a powder consolidation method at a pressure in the range from 100 to 1100 MPa to provide a green compact;

heating the green compact either in a protective atmosphere or under vacuum to a temperature over 1000° C. and holding the green compact at this temperature for at least 30 minutes, thereby sintering titanium to form a sintered compact; and cooling the sintered compact to form a sintered alloy article, wherein the sintered Ti alloy article has an ultimate tensile strength of at least 900 MPa, a yield strength of at least 800 MPa, and an elongation percentage of at least 6%.

11. The process according to claim 10, wherein the powder consolidation method comprises a room temperature consolidation method selected from die pressing, direct powder rolling, cold isostatic pressing, impulse pressing, or combination thereof.

12. The process according to claim 10, further comprising the step after consolidating the powder blend of:

heating the green compact to a temperature ranging from 100° C. to 250° C. to release absorbed water from the titanium powder prior to sintering.

13. The process according to claim 10, wherein titanium powder of the blended powder mixture comprises hydrogenated-dehydrogenated titanium powder or hydrogenated titanium powder.

14. The process according to claim 13, wherein titanium powder of the blended powder mixture comprises hydrogenated titanium powder and the method further includes the step of:

refining said green compact by heating to 300 to 900° C. and holding the green compact at such temperatures for at least 30 minutes.

15. The process according to claim 10, wherein the titanium powder is −100 to −500 mesh and at least 99 wt. % purity.

16. The process according to claim 10, wherein each of the elemental aluminum powder, copper powder, iron powder, silicon powder and $LaB_6$ powder is −325 mesh and at least 99 wt. % purity.

17. The process according to claim 10, wherein the elemental silicon and boron powders are either:

Premixed together prior to introduction into the blended powder; or introduced simultaneously into blended powder mixture.

18. The process according to claim 10, wherein the consolidation step pressure is from 200 to 800 MPa.

19. The process according to claim 10, wherein the sintering temperature is from 1000° C. to 1400° C.

20. The process according to claim 10, wherein the sintered alloy article has a sintered density of at least 95% of theoretical density.

* * * * *